US008176895B2

(12) United States Patent
Kusaka et al.

(10) Patent No.: US 8,176,895 B2
(45) Date of Patent: May 15, 2012

(54) ELECTRONIC CONTROL GOVERNOR

(75) Inventors: Hokuto Kusaka, Osaka (JP); Hideo Shiomi, Osaka (JP); Isao Takagawa, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 345 days.

(21) Appl. No.: 12/529,285

(22) PCT Filed: Feb. 26, 2008

(86) PCT No.: PCT/JP2008/053243

§ 371 (c)(1),
(2), (4) Date: Aug. 31, 2009

(87) PCT Pub. No.: WO2008/108214

PCT Pub. Date: Sep. 12, 2008

(65) Prior Publication Data

US 2010/0108030 A1 May 6, 2010

(30) Foreign Application Priority Data

Mar. 1, 2007 (JP) ..... 2007-051993
Mar. 1, 2007 (JP) ..... 2007-051994

(51) Int. Cl.
*F02D 31/00* (2006.01)

(52) U.S. Cl. ..... 123/357

(58) Field of Classification Search ..... 123/357, 123/446, 447, 506; 701/102, 103, 104
See application file for complete search history.

(56) References Cited

U.S. PATENT DOCUMENTS 5,083,982 A * 1/1992 Sato ..... 474/28
5,222,417 A * 6/1993 Sato ..... 474/28
5,432,693 A * 7/1995 Anderson ..... 363/41
5,673,166 A * 9/1997 Hoffman ..... 361/160
6,285,913 B1 * 9/2001 Hagglund ..... 700/45
7,192,005 B2 * 3/2007 Denyer et al. ..... 251/129.08
(Continued)

FOREIGN PATENT DOCUMENTS

JP 11-202947 7/1999
(Continued)

OTHER PUBLICATIONS

International Search Report for International Application No. PCT/JP2008/53243 dated May 8, 2008, 2 pgs.
(Continued)

*Primary Examiner* — Thomas Moulis
(74) *Attorney, Agent, or Firm* — Sterne, Kessler, Goldstein & Fox P.L.L.C.

(57) ABSTRACT

In an electronic control governor that adjusts the amount of fuel supplied to an engine so as to coincide an engine rotation speed with a target rotation speed, by driving an actuator for actuating a fuel adjusting mean due to an actuator driving current overlapped with a dither current, an amplitude or frequency of the dither current is changed, corresponding to a change in the supply quantity of the actuator driving current. Or, the amplitude and frequency of the dither current are changed corresponding to a change in the engine rotation speed. Alternatively, a ratio between turn-on time and turn-off time during one period of the dither current is changed, depending on the velocity ratio between the increased velocity and the decreased velocity of the actuator driving current. Preferably, the ratio of the turn-on time to one period of the dither current is set at 20 to 40%.

2 Claims, 18 Drawing Sheets

U.S. PATENT DOCUMENTS

| | | | | |
|---|---|---|---|---|
| 7,853,360 | B2 * | 12/2010 | Kissler Fernandez et al. | 700/275 |
| 7,872,436 | B2 * | 1/2011 | Kock et al. | 318/631 |
| 2004/0183366 | A1 * | 9/2004 | Kamiya et al. | 303/11 |

FOREIGN PATENT DOCUMENTS

| | | |
|---|---|---|
| JP | 2000-291474 | 10/2000 |
| JP | 2001-020789 | 1/2001 |
| JP | 2003-106241 | 4/2003 |
| JP | 2004-019665 | 1/2004 |
| JP | 2006-077580 | 3/2006 |
| WO | WO 2007/015485 | 2/2007 |

OTHER PUBLICATIONS

English translation of Office Action issued in connection with JP Application No. 2007-051993, Japanese Patent Office, mailed May 18, 2010, 2 pages.

* cited by examiner $T1 \fallingdotseq T2$

ELECTRONIC CONTROL GOVERNOR

BACKGROUND OF THE INVENTION

1. Field of the Invention

The present invention relates to an electronic control governor for adjusting the amount of fuel supplied to an engine so as to coincide an engine rotation speed with a target rotation speed, by driving an actuator for actuating a fuel adjusting means due to actuator driving current overlapped with a dither current.

2. Related Art

Conventionally, there is a well known electronic control governor, coordinately provided with a fuel injection device, as a governor for a diesel engine. The electronic control governor comprises a solenoid as an actuator for operating a fuel adjusting rack as a fuel adjusting means for adjusting the amount of fuel supply in the fuel injection device, and is constructed so that it controls the amount of fuel supplied to the engineby controlling the actuator using PWM. Hysteresis of the actuator or sliding resistance in a sliding portion such as the fuel adjusting rack is reducedby overlapping an actuator driving current for driving the actuator with a dither current so as to slightly vibrate the actuator (for example, see Patent Literature 1 and Patent Literature 2).

Patent Literature 1: the Japanese Patent Laid Open Gazette 2006-77580

Patent Literature 2: the Japanese Patent Laid Open Gazette 2001-20789

DISCLOSURE OF INVENTION

Problems to be Solved by the Invention

However, the amplitude of the actuator driving current overlapped with the dither current becomes smaller or larger than the adequate amplitudedue to a change of an engine load or an engine rotation speed. For example, when the engine load becomes higher, the electronic control governor increases the amount of fuel supply by increasing the supply quantity of the actuator driving current, so as to avoid engine stoppage. Thus, when the amplitude of the dither current is set to be uniform regardless of the change in the supply quantity of the actuator driving current, the amplitude of the dither current, which is set to correspond to the case when the supply quantity of the actuator driving current is large at a high engine load, becomes smaller, and the amplitude of the actuator driving current overlapped with the dither current is too small at a low engine load having a small amount of supply quantity of the actuator driving current, and is unable to achieve fully the effect of decreasing the hysteresis of the actuator as a target of the dither current or the sliding resistance of the sliding portion. Meanwhile, the amplitude of the dither current, which is set to correspond to the case when the supply quantity of the actuator driving current is small at a low engine load, becomes large, and the amplitude of the actuator driving current overlapped with the dither current is too large at a high engine load having a large amount of supply quantity of the actuator driving current, and the amplitude of the fuel adjusting means is too large, whereby the fluctuating range of the amount of fuel supply by the fuel injection device is increased, leading to the problem of being more likely to generate hunting of the engine.

When the frequency of the dither current is higher, i.e., the cycle of the PWM signal is shorter, the period set for increasing (while turning on the signal) or decreasing (while turning off the signal) the dither current becomes shorter during one period of the signal (one period means a combination of turning on at one time and turning off at one time). When the falling time of the current is short, the time needed for attenuating an actuator driving signal overlapped with the dither current is short, so that the attenuation is insufficient, and consequently, an amplitude of the actuator driving signal becomes small. When the frequency of the dither current is set to be uniform regardless of the change in the supply quantity of the actuator driving current, and the frequency of the dither current is set so as to correspond to the case when the supply quantity of the actuator driving current is large, the amplitude of the actuator driving current overlapped with the dither current is too small, thereby being fully unable to achieve the effect of decreasing the hysteresis of the actuator as a target of the dither current or the sliding resistance of the sliding portion. Meanwhile, when the frequency of the dither current is set so as to correspond to the case when the supply quantity of the actuator driving current is small, and the supply quantity of the actuator driving current is large, the amplitude of the actuator driving current overlapped with the dither current is too large, and the amplitude of the fuel adjusting means is too large, whereby fluctuating range of the amount of fuel supply by the fuel injection device is increased, leading to the problem of being more likely to generate hunting of the engine.

When the overlapped frequency of the dither current coincides with the vibrational frequency due to the engine rotation, a resonance phenomenon of the fuel adjusting means is generated. In this regard, the vibrational frequency of the engine is determined using the cycle number and the cylinder engine number as static factors, as well as the engine rotation speed as a mobilizing factor. When the frequency of the dither current is set to be uniform so as to correspond to the actuator driving current at a low rotation speed of the engine and the engine rotation speed is gradually increased, the vibrational frequency of the engine coincides with the frequency of the dither current at a certain time, leading to the problem of generating the resonance phenomenon of the engine.

Conventionally, for example, as shown in FIG. 17 referred to for the description of the after-mentioned fifth embodiment, the turn-on time and turn-off time of the PWM signal at one period of overlap of the dither current is set to be the same time (the turn-on time 50%, the turn-off time 50%). However, especially, when the actuator driving current is controlled so as to shorten the period of the PWM signal, in order to improve the responsiveness of the actuator using the electronic control governor, the turn-off time is relatively shorter with respect to the attenuating speed of the actuator driving current, and the attenuation of the actuator driving current during the turn-off time is insufficient. Consequently, as shown in FIG. 18 referred to for the description of the after-mentioned fifth embodiment, the amplitude of the actuator driving current (the difference between the actuator driving current and the target current) becomes smaller, thereby being fully unable to achieve the effect of decreasing the hysteresis of the actuator and the sliding resistance of the sliding portion.

SUMMARY OF THE INVENTION

Means for Solving the Problem

It's an objective of the present invention to provide an electronic control governor having a structure that adjusts the amount of fuel supplied to the engine so as to coincide the engine rotation speed with the target rotation speed, by driving the actuator for actuating the fuel adjusting means due to the actuator driving current overlapped with the dither current, thereby making the dither current appropriate, so as to be able to fully achieve the effect of decreasing the hysteresis of the actuator and the sliding resistance of the sliding portion.

In order to achieve this objective, an electronic control governor according to the first embodiment of the present invention adjusts the amount of fuel supplied to an engine so as to coincide an engine rotation speed with a target rotation speed, by driving an actuator for actuating fuel adjusting means due to actuator driving current overlapped with dither current, wherein the amplitude or frequency of the dither current is changed, depending on the change in the supply quantity of the actuator driving current.

In the electronic control governor according to the first embodiment as mentioned above, the amplitude or frequency of the dither current is changed, depending on the change in the supply quantity of the actuator driving current, and the amplitude of the actuator driving current overlapped with the dither current can be kept to be approximately constant at an adequate amplitude regardless of the change in the supply quantity of the actuator driving current, so that the amplitude of the fuel adjusting means actuated by a solenoid is restrained so as to be the adequate amplitude, and the fuel adjusting means can be prevented from being excessively actuated. As a result, the change in the amount of fuel supply can be stabilized, so as to prevent the hunting of the engine.

Preferably, the electronic control governor according to the first embodiment increases the supply quantity of the actuator driving current when the engine load is higher, wherein the amplitude or the frequency of the dither current is changed, based on a detection of the engine load.

Thus, the amplitude or the frequency of the dither current is changed, corresponding to the change in the engine load as a cause of the change in the supply quantity of the actuator driving current, whereby the amplitude of the actuator driving current overlapped with the dither current can be kept to be approximately constant at the adequate amplitude (over the whole load region of the engine) regardless of the change in the engine load, so that the amplitude of the fuel adjusting means actuated by a solenoid is restrained so as to be the adequate amplitude and the fuel adjusting means can be prevented from being excessively actuated. As a result, the change in the amount of fuel supply can be stabilized (over the whole load region of the engine) regardless of the change in the engine load, so as to prevent the hunting of the engine.

In the electronic control governor according to the first embodiment, preferably, when a large amount of actuator driving current is supplied, the amplitude of the dither current is low, compared to the case when a small amount of actuator driving current is supplied.

Accordingly, the dither current having a small amplitude is overlapped with the actuator driving current having a large supply quantity (for example, at a high load region of the engine load), and the dither current having a large amplitude is overlapped with the actuator driving current having a small supply quantity (for example, at a low load region of the engine load), so that an approximately constant and adequate amplitude of the actuator driving current can be achieved (over the whole load region of the engine load), as described above.

Alternatively, in the electronic control governor according to the first embodiment, preferably, when a large amount of actuator driving current is supplied, the frequency of the dither current is increased, compared to the case when a small amount of actuator driving current is supplied.

Accordingly, the dither current having a high frequency (consequently having a small amplitude) is overlapped with the actuator driving current having a large supply quantity (for example, at a high load region of the engine load), and the dither current having a small frequency (consequently having a large amplitude) is overlapped with the actuator driving current having a small supply quantity (for example, at a low load region of the engine load), so that an approximately constant and adequate amplitude of the actuator driving current can be achieved (over the whole load region of the engine load), as described above.

Alternatively, in the electronic control governor according to the first embodiment, preferably, when a large amount of actuator driving current is supplied, the amplitude of the dither current is low and the frequency thereof is increased, compared to the case when a small amount of actuator driving current is supplied.

Accordingly, the dither current having a small amplitude and high frequency is overlapped with the actuator driving current having a large supply quantity (for example, at a high load region of the engine load), and the dither current having a large amplitude and small frequency is overlapped with the actuator driving current having a small supply quantity (for example, at a low load region of the engine load), so that an approximately constant and adequate amplitude of the actuator driving current can be achieved (over the whole load region of the engine load), as described above.

In order to achieve the aforementioned objective, an electronic control governor according to the second embodiment of the present invention adjusts the amount of fuel supplied to an engine so as to coincide an engine rotation speed with a target rotation speed, by driving an actuator for actuating fuel adjusting means using an actuator driving current overlapped with a dither current, wherein the amplitude and frequency of the dither current are changed, depending on a change in the engine rotation speed.

In the electronic control governor according to the second embodiment, preferably, when the engine rotation speed is high, the amplitude of the dither current is low and the frequency thereof is increased, compared to the case when the engine rotation speed is low.

In the electronic control governor according to the second embodiment as mentioned above, the amplitude of the actuator driving current overlapped with the dither current can be kept to be approximately constant and at an adequate amplitude (over the whole rotation region of the engine) regardless of the engine rotation speed, so that the amplitude of the fuel adjusting means actuated by a solenoid is restrained so as to be the adequate amplitude and the fuel adjusting means can be prevented from being excessively actuated. As a result, the change in the amount of fuel supply can be stabilized, so as to prevent the hunting of the engine over the whole rotation region of the engine, regardless of the change in the engine rotation. In the case when the frequency of the dither current is set in accordance with low-speed rotation of the engine, as the engine rotation speed is increased, the frequency of the dither current is increased, coincidence of the vibrational frequency due to the engine rotation with the frequency of the dither current is avoided, thereby being able to preventing the resonance of the engine.

In order to achieve the aforementioned objective, an electronic control governor according to the third embodiment of the present invention adjusts the amount of fuel supplied to an engine so as to coincide an engine rotation speed with a target rotation speed, by driving an actuator for actuating fuel adjusting means using an actuator driving current overlapped with a dither current, wherein a ratio between the turn-on time and turn-off time of the dither current during one period is changed, in accordance with a speed ratio between the rate of increase and decrease of the actuator driving current.

Accordingly, even when the actuator driving current is controlled so that the vibration period thereof is shortened (the frequency thereof is increased), so as to improve the responsiveness of the actuator by the electronic control governor, the amplitude of the actuator driving current overlapped with the dither current can be increased by an appropriate amount. Therefore, the hysteresis of the actuator can be reduced and the sliding resistance of the sliding portion such as the fuel adjusting means provided with the fuel injection device can be loweredby overlapping the actuator driving current with the dither current, thereby preventing the hunting of the engine.

In the electronic control governor according to the third embodiment, preferably, a ratio of the turn-on time with respect to one period of the dither current is set to be 20 to 40%.

Accordingly, the ratio of the turn-on time with respect to one period of the dither current overlapped with the actuator driving current is optimized, so that the hysteresis of the actuator and the sliding resistance of the sliding portion such as the fuel adjusting means provided with the fuel injection device can be reduced.

DETAILED DESCRIPTION OF THE INVENTION

Figure 1:
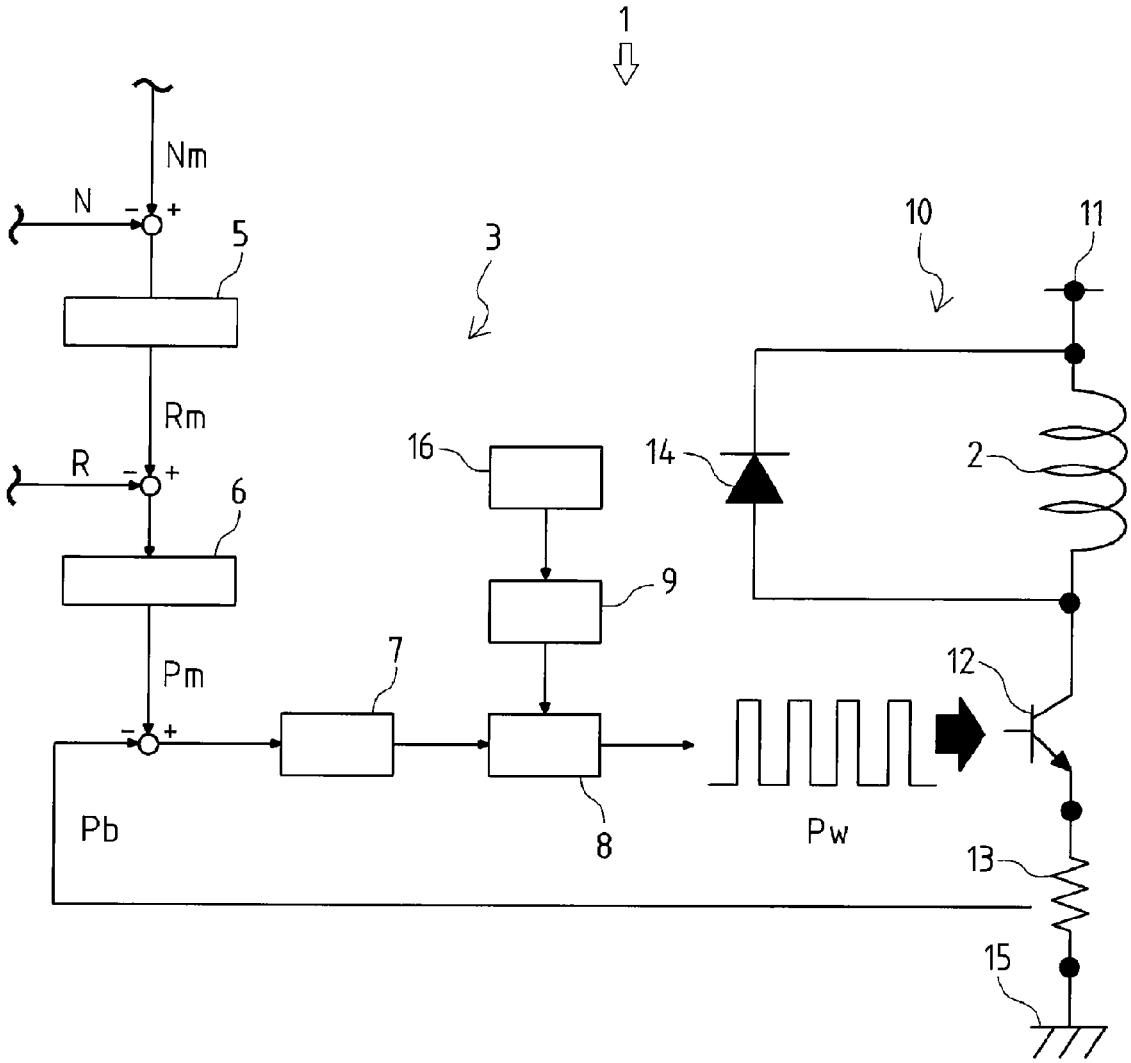
FIG. 1 is a diagram illustrating a construction of an electronic control governor according to one embodiment of the present invention.

Next, some embodiments of an electronic control governor of the present invention will be described. An entire construction of the electronic control governor will be described, with reference to FIG. 1. An electronic control governor 1 is provided so as to communicate with a fuel injection device, as a governor for a diesel engine. As shown in FIG. 1, the electronic control governor 1 includes a solenoid 2 as an actuator and an Electronic Control Unit (hereinafter, referred to as ECU) 3. The electronic control governor 1 is constructed so that it controls an actuator driving current supplied to the solenoid 2 by the ECU 3, so as to drive the solenoid 2.

The solenoid 2, which is driven based on the actuator driving current controlled by the ECU 3, actuates a fuel adjusting rack as a fuel adjusting means for adjusting the amount of fuel supply supplied from the fuel injection device so as to change the rack position thereof. The solenoid 2 adjusts the amount of fuel supply supplied from the fuel injection device to the engine, so that an actual engine rotation speed N of the engine corresponds to a target engine rotation speed Nm.

The ECU 3 includes a target rack position calculating portion 5, a target current calculating portion 6, a PWM signal calculating portion 7, a PWM signal output portion 8, a dither signal output portion 9 and a solenoid driving circuit 10. An engine target rotation speed Nm set by a target rotation speed setting means such as a speed control lever that sets up the engine target rotation speed Nm is input into the ECU 3.

An actual engine rotation speed N detected by a rotation speed detection means for detecting the engine rotation speed, an actual rack position R detected by a rack position detection means for detecting the rack position of the fuel adjusting rack and an energization current of the solenoid 2 detected by a shunt resistance 13 used as a current measuring resistance in the solenoid driving circuit 10 are input into the ECU 3.

In the ECU 3, a rotation speed deviation between the engine target rotation speed Nm set by target rotation speed setting means and the actual engine rotation speed N detected by a rotation speed detection means is calculated and is input into the target rack position calculating portion 5. A target rack position Rm of the fuel adjusting rack is calculated and output into the target rack position calculating portion 5, so as to practicably decrease the rotation speed deviation between the engine target rotation speed Nm and the actual engine rotation speed N.

A location deviation between the target rack position Rm output from the target rack position calculating portion 5 and the actual rack position R detected by the rack position detection means is calculated and is input into the target current calculating portion 6. A target current Pm to the solenoid 2 is calculated and output into the target current calculating portion 6, so as to practicably decrease the location deviation between the target rack position Rm and the actual rack position R.

Then, a current deviation between the target current Pm output from the target current calculating portion 6 and a detected current Pb detected by he shunt current 13 in the solenoid driving circuit 10 is calculated and output into the PWM signal calculating portion 7. In the PWM signal calculating portion 7, a duty ratio of the PWM signal is calculated and output into the PWM signal output portion 8, so as to practicably decrease the current deviation between the target current Pm and the detected current Pb.

A dither signal for controlling the dither current is generated in the dither signal output portion 9 and is output into the PWM signal output portion 8. The dither signal slightly vibrates the solenoid 2, so as to reduce the hysteresis of the solenoid 2 and the sliding resistance of the sliding portion such as the fuel adjusting rack of the fuel injection device. The dither signal is generated as a pulse signal having a constant period.

A dither indicating means 16 is connected to the dither signal output portion 9. The amplitude or period of the dither current is arbitrarily changeable in the dither indicating means 16 as mentioned below. The amplitude or period of the dither current is changed corresponding to the change in the engine load detected by the actual rack position R or the likeand the actual engine rotation speed N.

In the PWM signal output portion 8, a PWM signal Pw as a synthesized signal is generated by adding the dither signal generated in the dither signal output portion 9 to the PWM signal calculated in the PWM signal calculating portion 7 or by subtracting them. That is, the dither signal is overlapped with the PWM signal calculated in the PWM signal calculating portion 7.

The PWM signal Pw overlapped with the dither signal in the PWM signal output portion 8 is output into a switching element 12. Accordingly, the switching element 12 is opened or closed based on the PWM signal Pw input from the PWM signal output portion 8, and the driving current overlapped with the dither current is output into the solenoid 2 as the actuator through the solenoid driving circuit 10.

In the solenoid driving circuit 10, the solenoid 2, the switching element 12 and the shunt resistance 13 are connected in series between a power supply 11 and a GND 15 in this order, and a flywheel diode 14 is connected in parallel with the solenoid 2. A direct current such as a battery is used as the power supply 11, and a transistor is used as the switching element 12.

In the solenoid driving circuit 10, when the PWM signal Pw input from the PWM signal output portion 8 through the switching element 12 is turned on, the switching element 12 is closed. When the switching element 12 is closed, the actuator driving current flows from the power supply 11 through the solenoid 2, the switching element 12 and the shunt resistance 13 to a ground 15.

Meanwhile, when the PWM signal Pw input from the PWM signal output portion 8 through the switching element 12 is turned off, the switching element 12 is opened, and the actuator driving current does not flow. When an induced voltage is generated in the solenoid 2 as soon as the switching element 12 is opened, a reflux circuit is formed between the solenoid 2 and the flywheel diode 14, and a current due to the induced voltage is refluxed to the reflux circuit. Accordingly, the induced voltage is not applied to the switching element 12.

Thus, the electronic control governor 1 performs the feedback control, so as to approach the realistic values detected by the respective detection means to the target values in the ECU 3. The electronic control governor 1 outputs the actuator driving current overlapped with the dither current into the solenoid 2 through the solenoid driving circuit 10, and it drives the solenoid 2, so as to actuate the fuel adjusting rack. Accordingly, the electronic control governor 1 can adjust the amount of fuel supplied to the engine, so as to coincide the engine rotation speed N with the target engine rotation speed Nm.

As described above, in the electronic control governor 1, the hysteresis of the solenoid 2 is reduced and the sliding resistance of the sliding portion such as the fuel adjusting rack provided with the fuel injection device is reducedby overlapping the actuator driving current with the dither current. However, when the actuator driving current is controlled by shortening the period of the PWM signal in order to improve the responsiveness of the solenoid 2, there is a problem of being likely to cause the hunting of the engine, due to the engine load or the engine rotation speed.

In this case, the amplitude of the actuator driving current becomes smaller than the adequate amplitude, at a low load region where the amount of the actuator driving current overlapped with the dither current supplied to the solenoid 2 is small, and contrarily, the amplitude of the actuator driving current becomes larger than the adequate amplitudeat a high load region where the amount of the actuator driving current overlapped with the dither current supplied to the solenoid 2 is large. Therefore, as the amplitude of the fuel adjusting rack due to the vibration of the solenoid 2 is too large, depending on the change in the engine load or the engine rotation speed, the fluctuating range of the amount of fuel supplied by the fuel injection device is increased, thereby likely generating the hunting of the engine.

Among these, the problem at a low load region can be solved by further increasing the setting amplitude of the dither current and by further increasing the amplitude of the actuator driving current overlapped with the dither current. However, when the engine load is transferred from the low load region to the high load region, the amplitude of the actuator driving current is excessively increased, so that the problem at a high load region cannot be solved. In the present invention, the aforementioned problems may be solved, for example, using the following embodiments 1 to 4.

Embodiment 1

Figure 4:
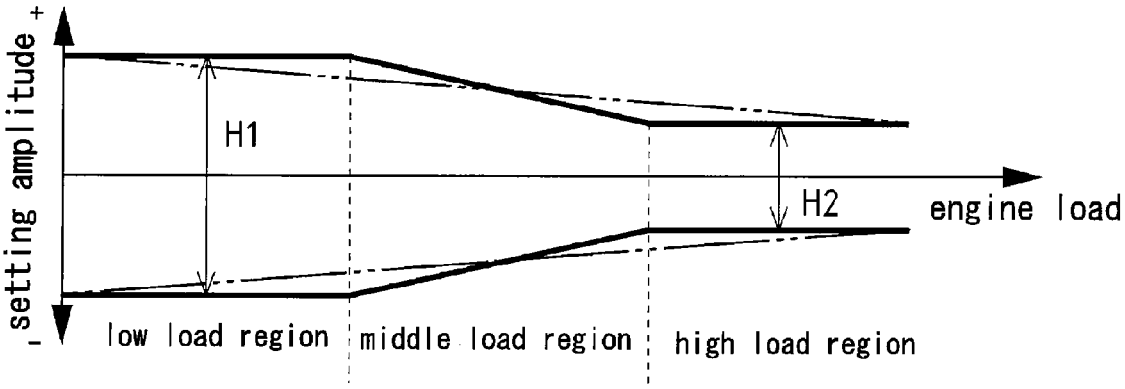
FIG. 4 is a diagram illustrating a relationship between the setting amplitude of the dither current and an engine load according to the first embodiment.
Figure 5:
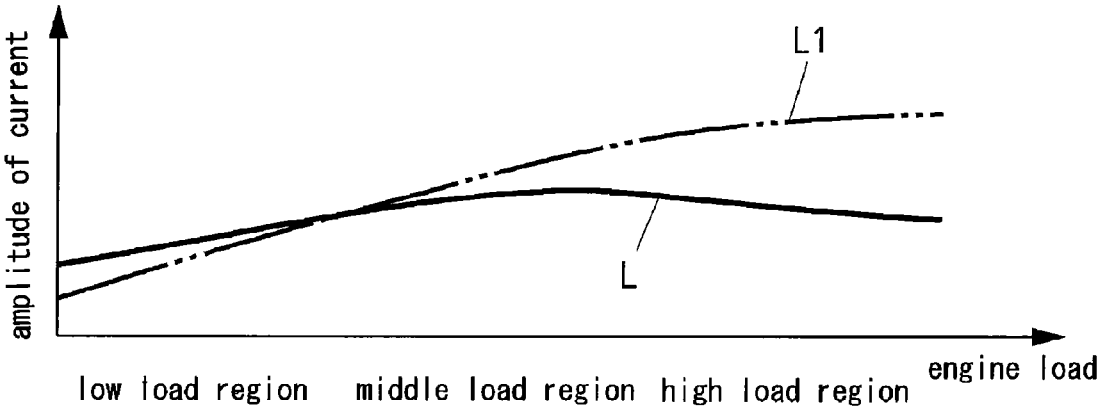
FIG. 5 is a diagram illustrating a relationship between the amplitude of the actuator driving current overlapped with the dither current and the engine load according to the first embodiment.

Embodiment 1 will be described, with reference to FIGS. 4 to 6. In the present embodiment, in the ECU 3, the amount of driving current supplied to the actuator, i.e., the engine load, is calculated, for example, based on the actual rack position R of the fuel adjusting rack detected by the rack position detection means, the target rack position Rm, the actual engine rotation speed Nm, a map or the like. In this regard, since the engine load can be also calculated by the angular velocity of the rotation speed or the like, the calculating method is limited to the aforementioned one. The setting amplitude of the dither current corresponding to the engine load is calculated, using the diagram (the map) illustrating the relationship between the engine load and the amplitude of the dither current memorized by memorizing means (not shown) in the ECU 3 as shown in FIG. 4, and the dither signal is set by the dither indicating means 16, so as to be output from the dither signal output portion 9. The dither signal is overlapped with the PWM signal in the PWM signal output portion 8, thereby making the amplitude of the actuator driving current the adequate amplitude.

In other words, as shown in FIG. 4, the amplitude H of the dither current is set to be larger at a low load region, smaller at a high load region and smaller by increasing the load at middle load region, with respect to the engine load. The amplitude H of the dither current is changed so that it becomes the first setting amplitude H1 while the engine load is at a low load region and becomes the second setting amplitude H2 that is smaller than the first setting amplitude H1 while the engine load is at a high load region. At the middle load region, the amplitude H of the dither current is changed so that it gradually becomes smaller from the first setting amplitude H1 to the second setting amplitude H2, as the amplitude H is transferred from the low load region to the high load region. The dither current is overlapped with the actuator driving current.

Figure 3:
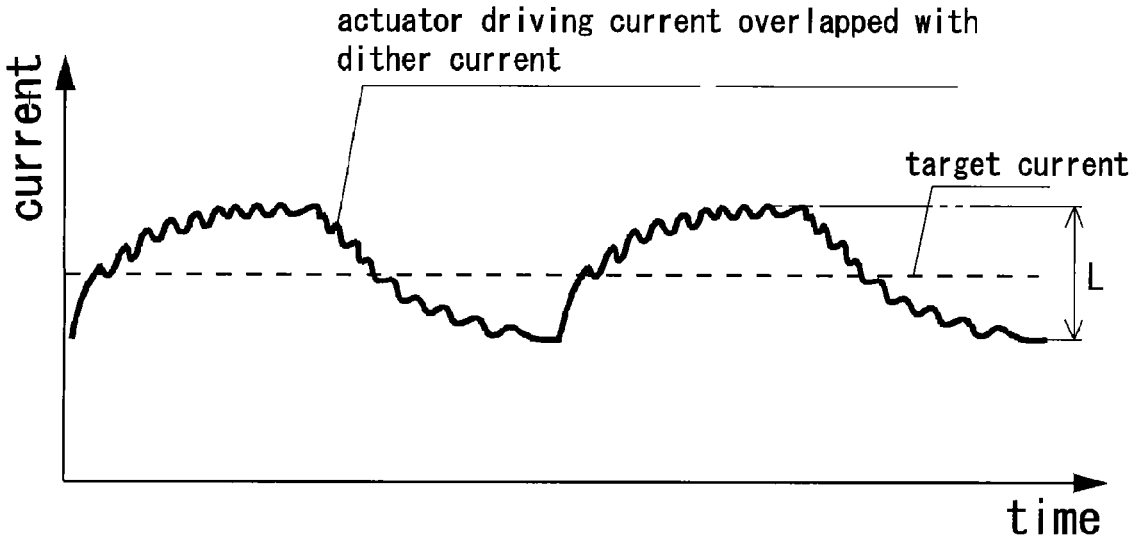
FIG. 3 is a waveform chart of the actuator driving current overlapped with the dither current.

Accordingly, the amplitude L of the actuator driving current overlapped with the dither current as shown in FIG. 3 is also changed so that it becomes larger or smaller corresponding to the change in the engine load. As shown in FIG. 5, the amplitude L of the actuator driving current overlapped with the dither current is increased to the adequate amplitude from the low load region to the middle load region, as the amplitude H of the dither current is set to be larger. Meanwhile, as the amplitude H of the dither current is set to be smaller at a high load region, the increased range is decreased compared with the case at a low load region, so as to be restrained to the adequate amplitude.

In other words, the amplitude H of the dither current is changed so that the increased range of the amplitude L of the actuator driving current overlapped with the dither current becomes larger or constant at a low load region, and the increased range becomes smaller than the amplitude L1 when the amplitude H of the dither current is at the first setting amplitude H1 without changing from the low load region to the high load region, whereby the amplitude L of the actuator driving current overlapped with the dither current is kept to be approximately constant and at the appropriate amplitude over the whole load region of the engine.

Figure 6:
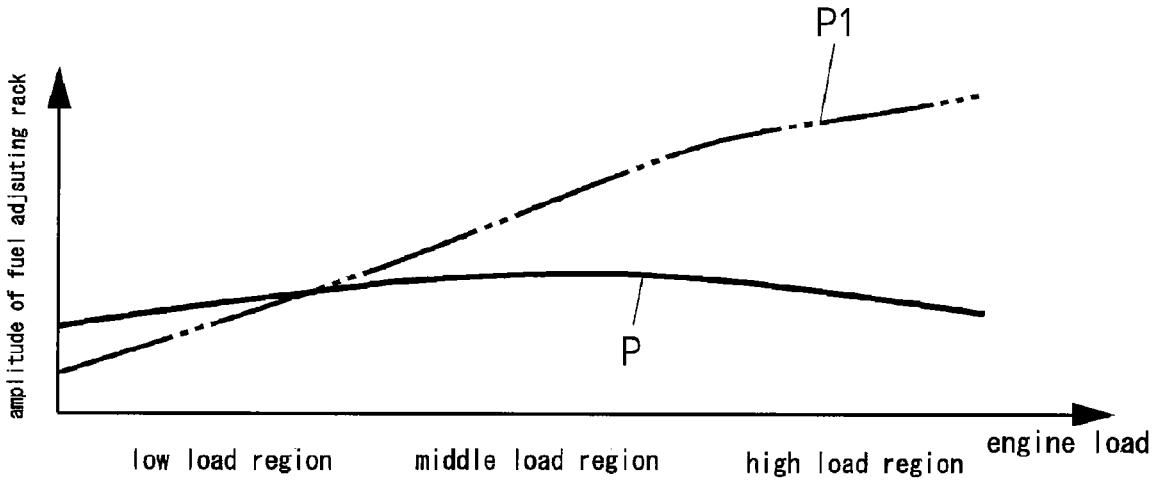
FIG. 6 is a diagram illustrating a relationship between the amplitude of a fuel adjusting rack and the engine load according to the first embodiment.

Therefore, as shown in FIG. 6, the amplitude P of the fuel adjusting rack actuated by the solenoid 2 is restrained, compared with the amplitude P1 when the amplitude of the dither current is at the first setting amplitude H1 without changing from the low load region to the high load region, so as to be the adequate amplitude, thereby preventing the fuel adjusting rack from excessively actuating. Accordingly, the variation of the amount of fuel supplied from the fuel injection device to the engine can be stabilized, so that the hunting of the engine can be prevented over the whole load region regardless of the change in the engine load.

Incidentally, in the aforementioned construction, the amplitude H of the dither current is changed to the first setting amplitude H1 at a low load region and to the second setting amplitude H2 at high load region, so that the amplitude L of the actuator driving current overlapped with the dither current becomes the appropriate amplitude. As indicated by a two-dot chain line in FIG. 4, the amplitude H of the dither current may be changed so as to be gradually smaller as the engine load becomes higher, so that the amplitude L of the actuator driving current overlapped with the dither current becomes the appropriate amplitude.

As seen from above, according to embodiment 1, in the electronic control governor 1, which adjusts the amount of fuel supplied to the engine so as to coincide the engine rotation speed with the target rotation speed, by driving the solenoid (the actuator) 2 for actuating the fuel adjusting means, due to the actuator driving current overlapped with the dither current, the amplitude of the dither current overlapped with the actuator driving current is constructed so that it can be changed, whereby the amplitude of the actuator driving current overlapped with the dither current can be kept approximately constant and at the adequate amplitude over the whole load region of the engine, by reducing the amplitude of the dither current when the engine load is high (when the amount of the actuator driving current supplied to the solenoid 2 is large), compared with the case when the engine load is low (small). Accordingly, the amplitude P of the fuel adjusting rack (the fuel adjusting means) actuated by the solenoid 2 is restrained, so as to be the adequate amplitude, thereby preventing the fuel adjusting rack from excessively actuating. Consequently, the variation of the amount of fuel supply can be stabilized, so that the hunting of the engine can be prevented over the whole load region regardless of the change in the engine load.

Embodiment 2

Figure 7:
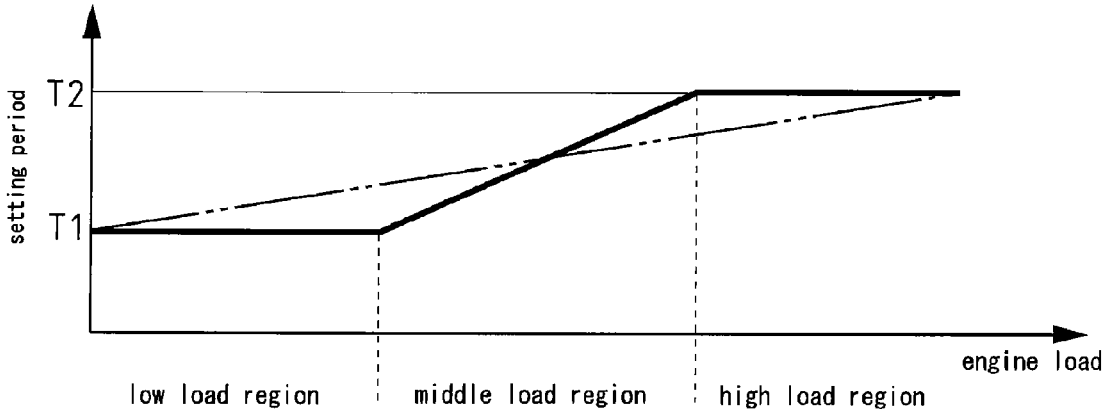
FIG. 7 is a diagram illustrating a relationship between the setting period of the dither current and the engine load according to the second embodiment.
Figure 8:
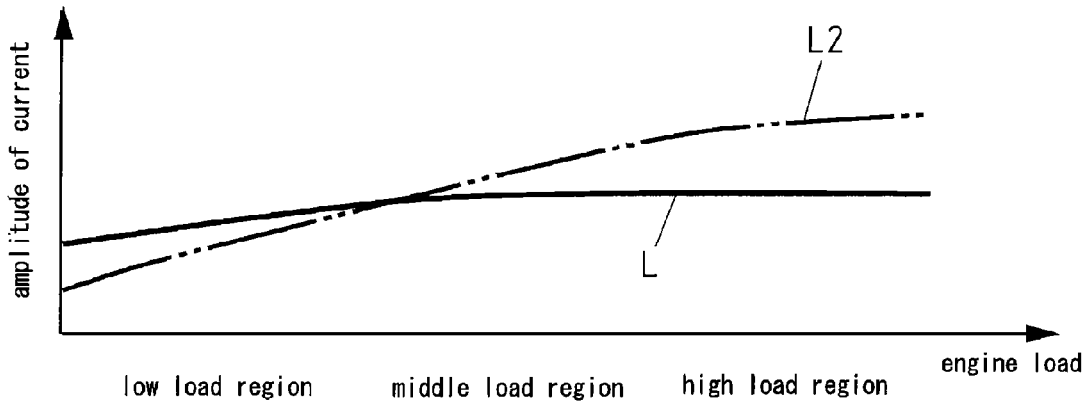
FIG. 8 is a diagram illustrating a relationship between the amplitude of the actuator driving current overlapped with the dither current and the engine load according to the second embodiment.

Embodiment 2 will be described, with reference to FIGS. 7 to 9. In the present embodiment, in the ECU 3, the amount of the driving current supplied to the actuator, i.e., the engine load, is detected, for example, based on the actual rack position R of the fuel adjusting rack detected by the rack position detection means, the target rack position Rm, the actual engine rotation speed N, the map or the like. The appropriate setting period corresponding to the engine load is calculated, based on the relationship between the engine load and the period T of the dither current memorized by memorizing means (not shown) in the ECU 3 as shown in FIG. 7, and the dither signal is set by the dither indicating means 16, so as to be output from the dither signal output portion 9. The dither signal is overlapped with the PWM signal in the PWM signal output portion 8, thereby making the amplitude of the actuator driving current the adequate amplitude.

In other words, as shown in FIG. 7, the period T of the dither current is changed so that it becomes the first setting period T1 having a longer period (having alow frequency) while the engine load is at a low load region and so that it becomes the second setting period T2 that is shorter than the first setting period T1 (having a high frequency) while the engine load is at a high load region. In the middle load region, the period T of the dither current is changed so that it gradually becomes smaller from the first setting period T1 to the second setting period T2, as the period T is transferred from the low load region to the high load region. The dither current is overlapped with the actuator driving current.

Accordingly, the amplitude L of the actuator driving current overlapped with the dither current as shown in FIG. 3 is changed so that it becomes larger or smaller corresponding to the change in the engine load. As shown in FIG. 8, since the period T of the dither current is long (the frequency is low) at the low load region, the fall time of the actuator driving current overlapped with the dither current is long, whereby the actuator driving current is fully attenuated. Therefore, the difference between the actuator driving current and the target current become larger, and the ascent velocity in the initial rise of the actuator driving current is accelerated, so that the amplitude L of the actuator driving current becomes large so as to be the appropriate amplitude.

Meanwhile, because the period T of the dither current is short (the frequency is high) at the high load region, the fall time of the actuator driving current overlapped with the dither current is short, whereby the actuator driving current is not fully attenuated. Therefore, the difference between the actuator driving current and the target current become smaller, and the ascent velocity in the initial rise of the actuator driving current is decelerated and the descent velocity in the trailing edge of the actuator driving current is slowed, so that the increased range of the amplitude L of the actuator driving current is reduced compared with the increased range at a low load region, so as to be restrained up to the appropriate amplitude.

In other words, the period T of the dither current is changed so that the increased range of the amplitude L of the actuator driving current overlapped with the dither current becomes larger or constant at a low load region, and the increased range becomes smaller than the amplitude L2 when the period T of the dither current is at the first setting period T1 without changing from the low load region to the high load region, whereby the amplitude L of the actuator driving current overlapped with the dither current is kept approximately constant and at the appropriate amplitude over the whole load region of the engine.

Figure 9:
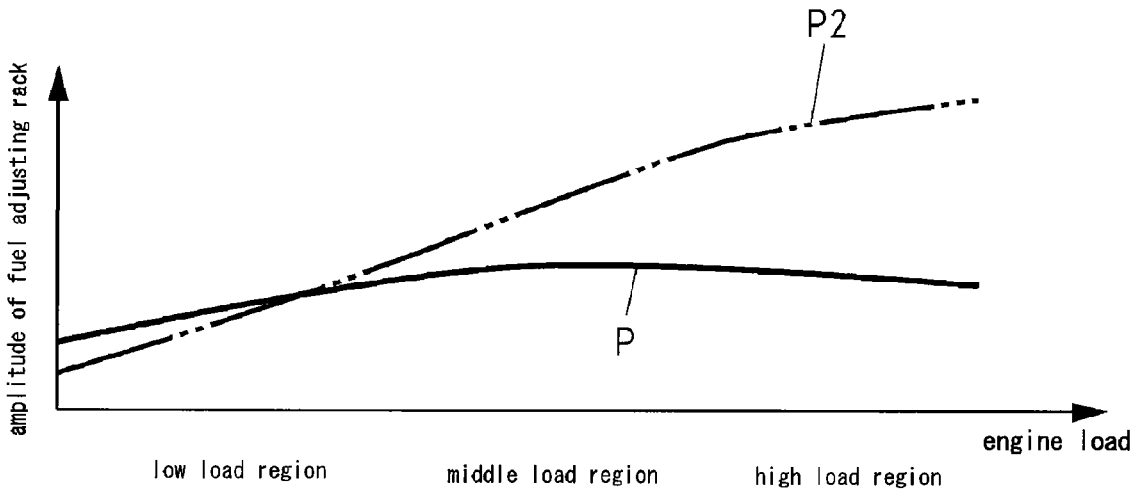
FIG. 9 is a diagram illustrating a relationship between the amplitude of a fuel adjusting rack and the engine load according to the second embodiment.

Therefore, as shown in FIG. 9, the amplitude P of the fuel adjusting rack actuated by the solenoid 2 is restrained, compared with the amplitude P2 when the amplitude of the dither current is at the first setting period T1 without changing from the low load region to the high load region, so as to be the adequate amplitude, thereby being able to prevent the fuel adjusting rack from excessively actuating. Accordingly, the variation of the amount of fuel supplied from the fuel injection device to the engine can be stabilized, so that the hunting of the engine can be prevented over the whole load region regardless of the change in the engine load.

Incidentally, in the aforementioned construction, the period T of the dither current is changed to the first setting period T1 at a low load region and to the second setting period T2 at a high load region, so that the amplitude L of the actuator driving current overlapped with the dither current becomes the appropriate amplitude. As indicated by a two-dot chain line in FIG. 7, the period of the dither current may be changed so as to gradually decrease as the engine load becomes higher, so that the amplitude L of the actuator driving current overlapped with the dither current becomes the appropriate amplitude.

As seen from above, according to embodiment 2, in the electronic control governor 1, which adjusts the amount of fuel supplied to the engine so as to coincide the engine rotation speed with the target rotation speed, by driving the solenoid (the actuator) 2 for actuating the fuel adjusting means, due to the actuator driving current overlapped with the dither current, the period (frequency) of the dither current overlapped with the actuator driving current is constructed so that it can be changed, so that the amplitude of the actuator driving current overlapped with the dither current can be kept to be approximately constant at the adequate amplitude over the whole load region of the engine, by reducing the period (increasing the frequency) of the dither current when the engine load is high (when the amount of the actuator driving current supplied to the solenoid 2 is large), compared with the case when the engine load is low (small). Accordingly, the amplitude P of the fuel adjusting rack (the fuel adjusting means) actuated by the solenoid 2 is restrained, so as to be the adequate amplitude, thereby preventing the fuel adjusting rack from excessively actuating. Consequently, the variation of the amount of fuel supply can be stabilized, so that the hunting of the engine can be prevented over the whole load region regardless of the change in the engine load.

Embodiment 3

In the present embodiment, in the ECU 3, the amount of the driving current supplied to the actuator, i.e., the engine load, is detected, for example, based on the rack position of the fuel adjusting rack detected by the rack position detection means, the target rack position Rm, the actual engine rotation speed N, the map or the like. Depending on the engine load, the dither signal is set by the dither indicating means 16, and is output from the dither signal output portion 9, so that the amplitude H of the dither current is changed into the appropriate setting amplitude as with the aforementioned embodiment 1, and so that the period T of the dither current is changed to the appropriate setting period as with the aforementioned embodiment 2. The dither current is overlapped with the PWM signal at the PWM signal output portion, whereby the amplitude of the actuator driving current becomes the appropriate amplitude.

In this way, the amplitude L of the actuator driving current overlapped with the dither current is kept approximately constant and at an allowable largeness over the whole load region of the engine. Therefore, the amplitude P of the fuel adjusting rack actuated by the solenoid 2 is restrained, compared with the amplitude P1 and the first setting period T1 when the amplitude of the dither current is at the first setting amplitude H1 without changing from the low load region to the high load region, so as to be the adequate amplitude, thereby preventing the fuel adjusting rack from excessively actuating. Accordingly, the variation of the amount of fuel supplied from the fuel injection device to the engine can be stabilized, so that the hunting of the engine can be prevented over the whole load region regardless of the change in the engine load.

As seen from above, according to embodiment 3, in the electronic control governor 1, which adjusts the amount of fuel supplied to the engine so as to coincide the engine rotation speed with the target rotation speed, by driving the solenoid (the actuator) 2 for actuating the fuel adjusting means, due to the actuator driving current overlapped with the dither current, the amplitude and period (frequency) of the dither current overlapped with the actuator driving current is constructed so that it can be changed, whereby the amplitude of the actuator driving current overlapped with the dither current can be kept approximately constant and at the adequate amplitude over the whole load region of the engine, by reducing the amplitude of the dither current and by shortening the period (increasing the frequency) of the dither current when the engine load is high (when the amount of the actuator driving current supplied to the solenoid 2 is large), compared with the case when the engine load is low (small). Accordingly, the amplitude P of the fuel adjusting rack (the fuel adjusting means) actuated by the solenoid 2 is restrained, so as to be the adequate amplitude, thereby preventing the fuel adjusting rack from excessively actuating. Consequently, the variation of the amount of fuel supply can be stabilized, so that the hunting of the engine can be prevented over the whole load region regardless of the change in the engine load.

Embodiment 4

Figure 2:
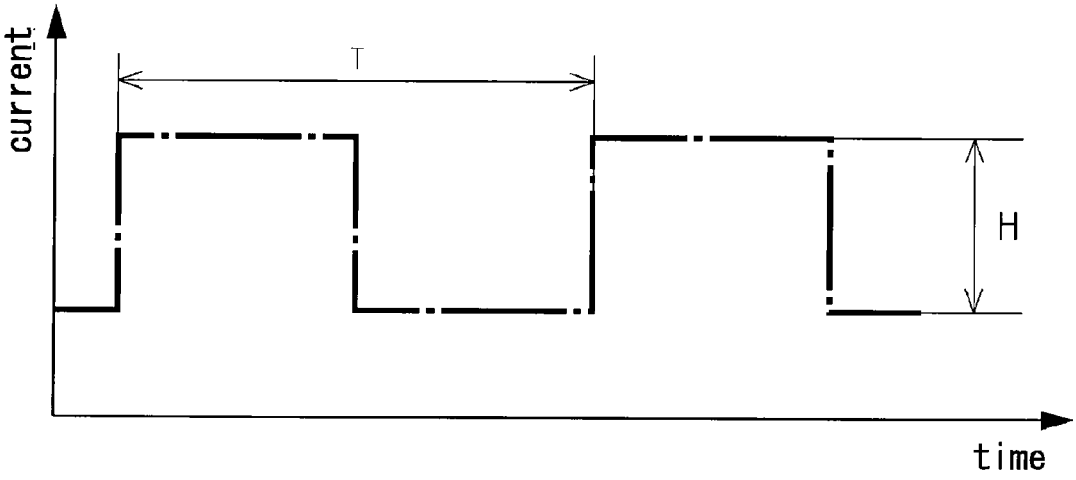
FIG. 2 is a waveform chart of a dither current overlapped with an actuator driving current.

Embodiment 4 will be described, with reference to FIGS. 10 to 13. In the present embodiment, in the ECU 3, depending on the variation of the actual engine rotation speed N detected by the rotation speed detection means, the dither signal is set by the dither indicating means 16, and is output from the dither signal output portion 9, so that the amplitude H of the dither current as shown in FIG. 2 is changed to the appropriate setting amplitude, and so that the period T of the dither current is changed to the appropriate setting period. The dither current is overlapped with the PWM signal at the PWM signal output portion, thereby making the amplitude of the actuator driving current the appropriate amplitude.

Figure 10:
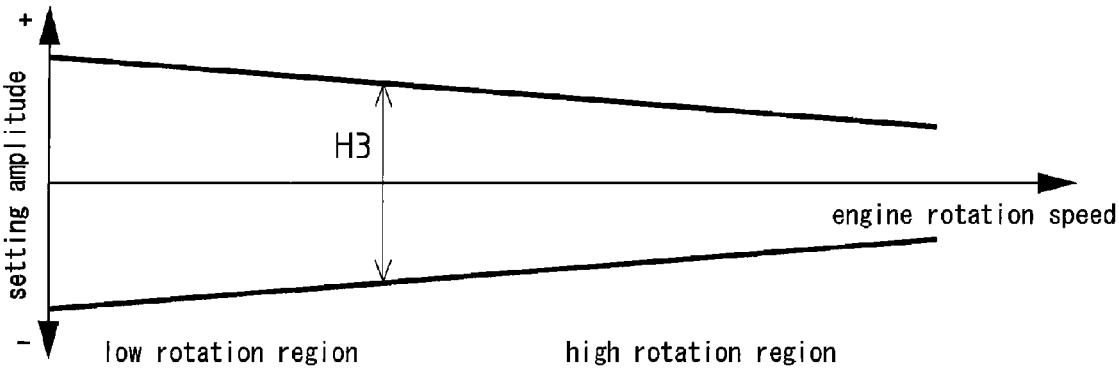
FIG. 10 is a diagram illustrating a relationship between the setting amplitude of the dither current and the engine rotation speed according to the fourth embodiment.
Figure 11:
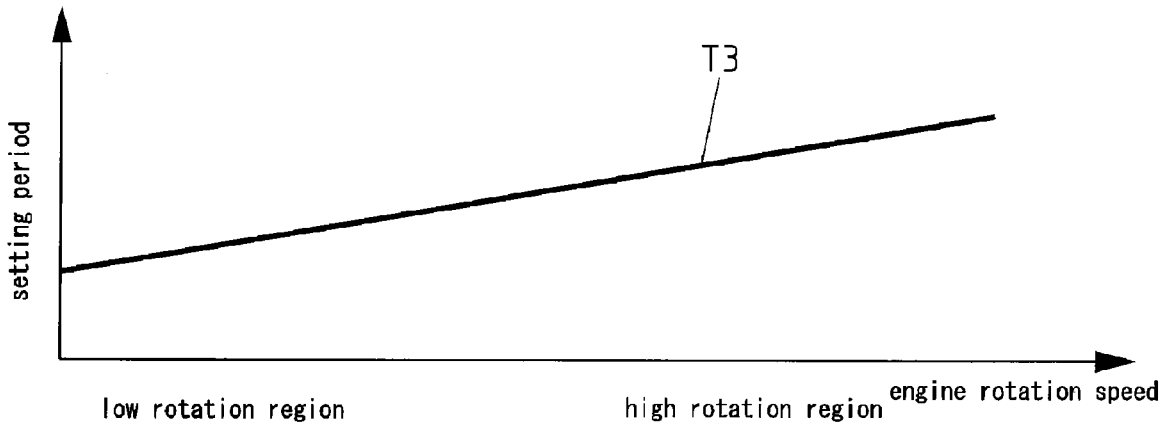
FIG. 11 is a diagram illustrating a relationship between the setting period of the dither current and the engine rotation speed according to the fourth embodiment.

More specifically, as shown in FIG. 10, as the actual engine rotation speed N is transferred from the low rotation region to the high rotation region, the amplitude H of the dither current is changed so as to be gradually smaller, so that it becomes the setting amplitude H3. Moreover, as shown in FIG. 11, as the actual engine rotation speed N is transferred to the low rotation region from the high rotation region, the period T of the dither current is changed so as to be gradually shorted (so as to gradually increase the frequency thereof), so that it becomes the setting period T3.

Figure 12:
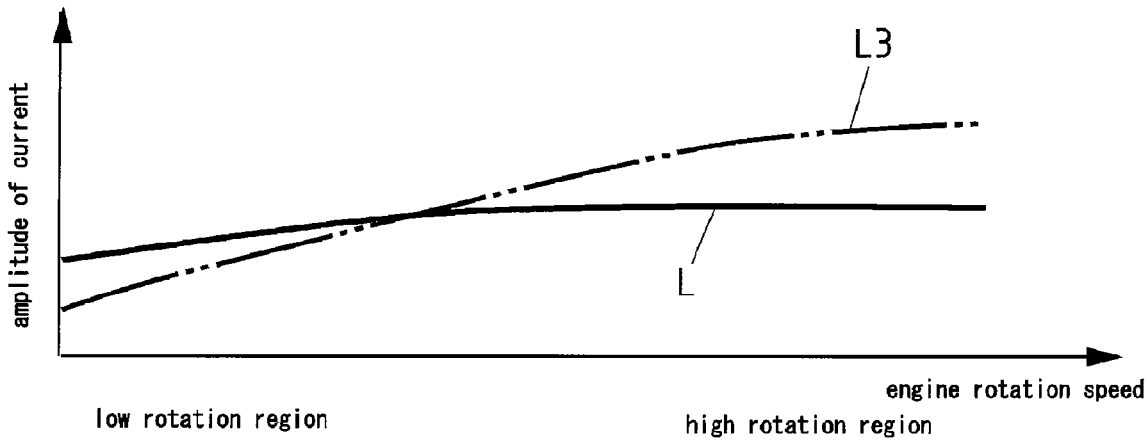
FIG. 12 is a diagram illustrating a relationship between the amplitude of the actuator driving current overlapped with the dither current and the engine rotation speed according to the fourth embodiment.

Accordingly, the amplitude of the actuator driving current overlapped with the dither current as shown in FIG. 3 is also changed so as to be large or small corresponding to the variation of the engine rotation speed. As shown in FIG. 12, the engine rotation speed is increased to the appropriate amplitude from the low rotation region to the middle rotation region, and the increasing range thereof at the high rotation region is decreased compared with the increasing range at the low rotation region, whereby the amplitude of the actuator driving current overlapped with the dither current is restrained to the appropriate amplitude.

More specifically, the amplitude H and the period T of the dither current are changed, so that the increasing range of the amplitude L of the actuator driving current overlapped with the dither current becomes large or constant at the low rotation region, and so that the increasing range becomes smaller than the amplitude L3 when the amplitude H of the dither current is not changed from the low rotation region at a high rotation region, whereby the amplitude L of the actuator driving current overlapped with the dither current is kept to be approximately constant at the appropriate amplitude over the whole rotation region of the engine.

Figure 13:
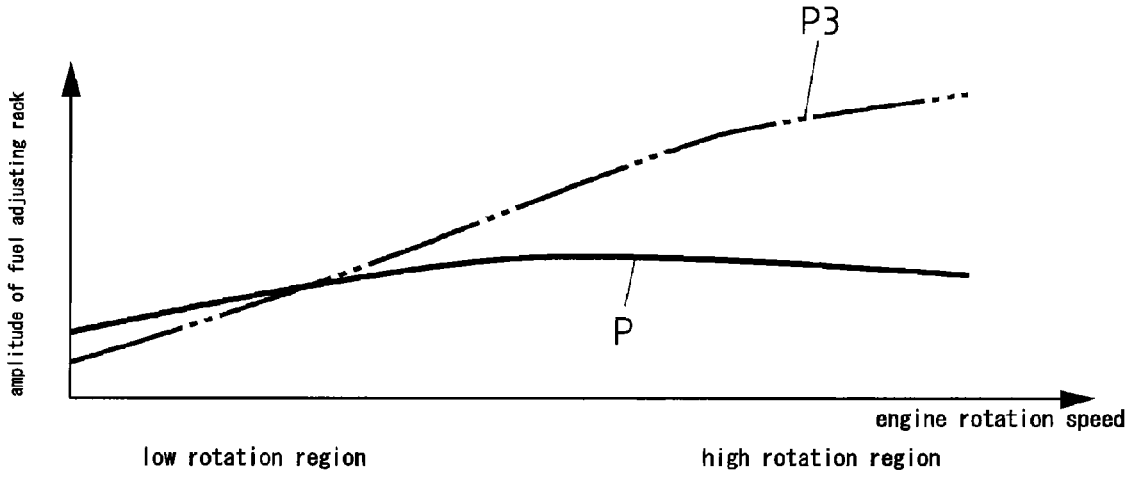
FIG. 13 is a diagram illustrating a relationship between the amplitude of a fuel adjusting rack and the engine rotation speed according to the fourth embodiment.

Therefore, as shown in FIG. 13, the amplitude P of the fuel adjusting rack actuated by the solenoid 2 is restrained, compared with the amplitude P3 when the amplitude and the period of the dither current is not changed from the low rotation region to the high rotation region, so as to be the adequate amplitude, thereby being able to prevent the fuel adjusting rack from excessively actuating. Accordingly, the variation of the amount of fuel supplied from the fuel injection device to the engine can be stabilized, so that the hunting of the engine can be prevented over the whole rotation region regardless of the change in the engine rotation speed. When the frequency of the dither current is set corresponding to the low-speed rotation of the engine and the engine rotation speed is accelerated, the frequency of the dither current is increased, so that a coincidence of the vibrational frequency due to the engine rotation with the frequency of the dither current is avoided, so as to prevent the resonance of the engine.

As seen from above, according to embodiment 4, in the electronic control governor 1, which adjusts the amount of fuel supplied to the engine so as to coincide the engine rotation speed with the target rotation speed, by driving the solenoid (the actuator) 2 for actuating the fuel adjusting means, due to the actuator driving current overlapped with the dither current, the amplitude and period (frequency) of the dither current overlapped with the actuator driving current is constructed so that it can be changed, whereby the amplitude of the actuator driving current overlapped with the dither current can be kept approximately constant and at the adequate amplitude over the whole rotation region of the engine, by reducing the amplitude of the dither current and by shortening the period (increasing the frequency) of the dither current when the engine rotation speed is high, compared with the case when the engine rotation speed is low. Accordingly, the amplitude P of the fuel adjusting rack (the fuel adjusting means) actuated by the solenoid 2 is restrained, so as to be the adequate amplitude, thereby preventing the fuel adjusting rack from excessively actuating. Consequently, the variation of the amount of fuel supply can be stabilized, so that the hunting of the engine can be prevented over the whole rotation region regardless of the change in the engine rotation speed. The resonance of the engine, caused by the coincidence of the engine vibrational frequency due to the engine rotation with the frequency of the dither current, can be prevented.

Embodiment 5

Embodiment 5 will be described, with reference to FIGS. 14 to 16. Embodiment 5 relates to setting the turn-on time and turn-off time at one period of the dither current. Setting the turn-on time and turn-off time at one period of the dither current in the conventional electronic control device will be described, with reference to FIGS. 17 and 18.

Figure 17:
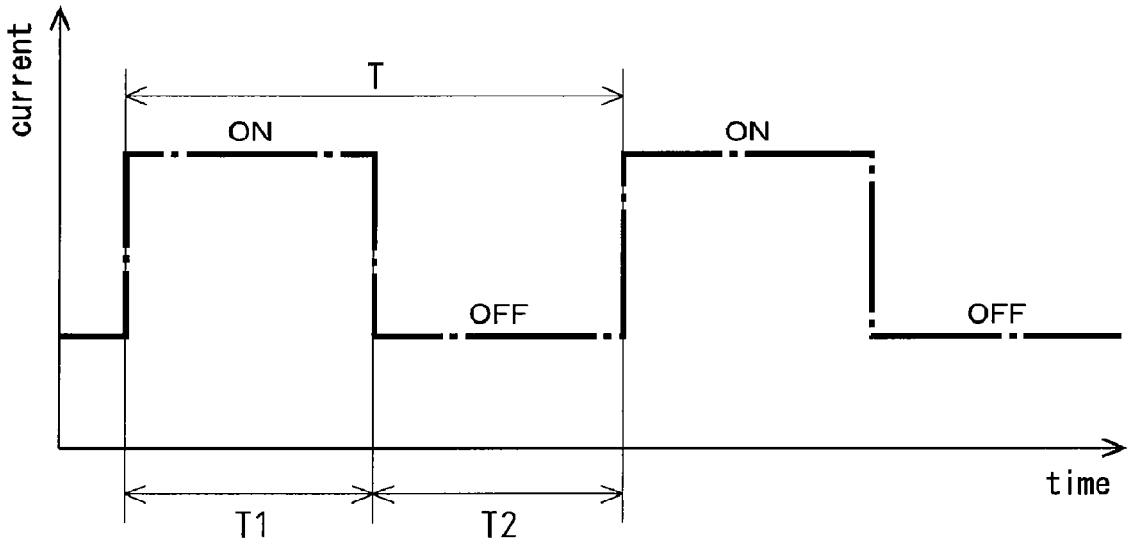
FIG. 17 is a conventional waveform chart of a dither current overlapped with the actuator driving current.
Figure 18:
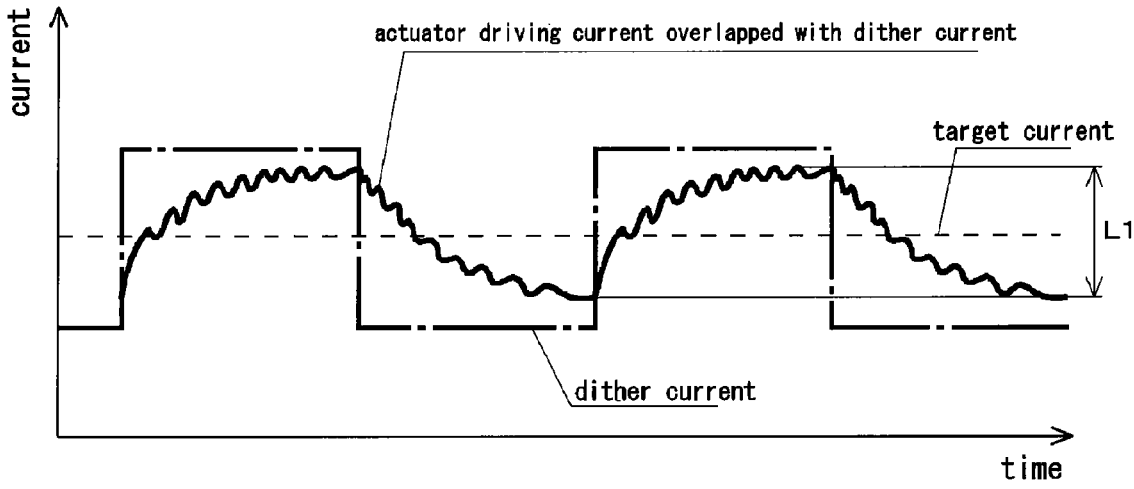
FIG. 18 is a conventional waveform chart of the actuator driving current overlapped with the dither current.

As shown in FIG. 17, for example, in the conventional electronic control device, the dither signal is set, so that the ratio of the turn-on time T1 to one period T of the dither current is 50%, i.e., the ratio of the turn-on time T1 and the turn-off time T2 is equal, and as shown in FIG. 18, the dither current is overlapped with the actuator driving current. The actuator driving current overlapped with the dither current is controlled so as to approach a target current, by approximately equalizing the initial rise while the dither current is on the turn-on time (ascent velocity of synthesized signal) and the trailing edge while the dither current is on the turn-off time (descent velocity of synthesized signal).

However, when the period of the PWM signal is shortened (the frequency thereof is increased), in the control by which the ratio of the turn-on time T1 to one period T of the dither current is set at 50%, the turn-off time is not fully secured for the descent velocity in the trailing edge of the actuator driving current. Briefly, the actuator driving current is insufficiently attenuated. Therefore, as the difference between the actuator driving current and the target current is shrunk, the ascent velocity in the initial rise of the actuator driving current is decelerated and the descent velocity in the trailing edge is decelerated, thereby reducing the amplitude L1 of the actuator driving current.

For this reason, even when the dither current is overlapped with the actuator driving current, as the solenoid 2 cannot be vibrated in proper largeness, the aforementioned problem of increasing the hysteresis, leading to the hunting of the engine, is caused. In this regard, in the electronic control governor 1 according to the embodiment 5 as shown in FIGS. 14 to 16, the ratio of the turn-on time to one period of the dither current is changed, corresponding to the velocity ratio of the ascent and descent of the actuator driving current overlapped with the dither current, so as to solve the aforementioned problem.

More specifically, in the dither indicating means 16 of the ECU 3, the dither signal is set and the dither current is controlled, so as to distinguish the ratio of the turn-on time to one period of the dither current. When the ratio of the turn-on time to one period of the dither current (T1/T) is controlled so that it is over 50% and the turn-on time T1 is longer than the turn-off time T2 during one period of the dither current, the actuator driving current overlapped with the dither current is not fully attenuated in the trailing edge, as is the case with the conventional construction, thereby causing a similar problem.

Figure 14:
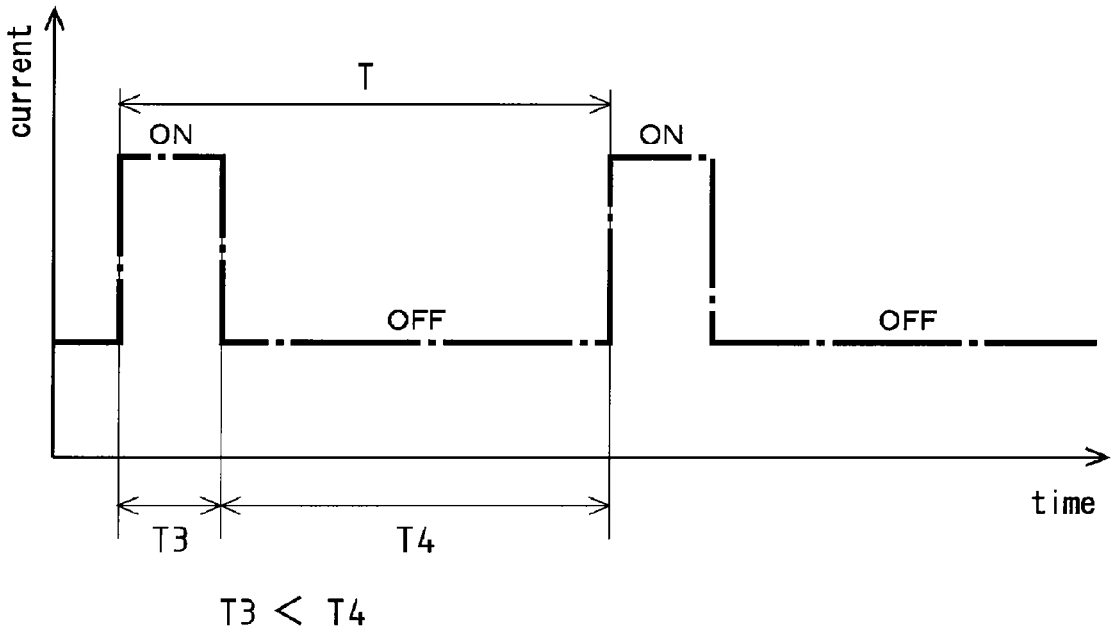
FIG. 14 is a waveform chart of a dither current overlapped with the actuator driving current according to the fifth embodiment.
Figure 15:
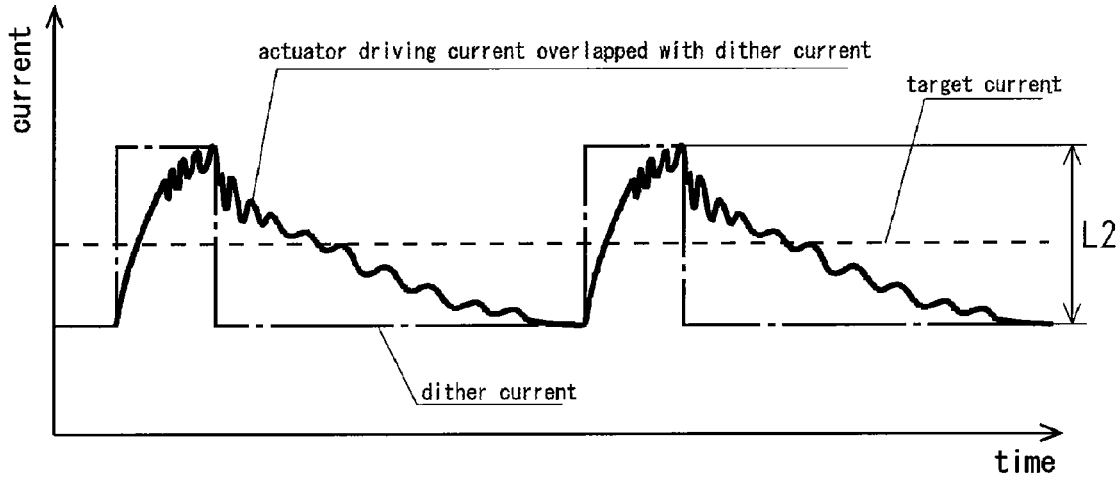
FIG. 15 is a waveform chart of the actuator driving current overlapped with the dither current according to the fifth embodiment.

Therefore, as shown in FIG. 14, the ratio of the turn-on time to one period of the dither current (T3/T) is controlled so that it is not over 50% and the turn-on time T3 is shorter than the turn-off time T4 during one period T of the dither current, so as to easily attenuate the actuator driving current overlapped with the dither current during the trailing edge. The actuator driving current overlapped with the dither current is output into the solenoid 2, as a waveform as shown in FIG. 15 in which the current is used as the axis of ordinate and the time is used as the axis of abscissas.

In this case, since the fall time of the actuator driving current is longer, the actuator driving current is sufficiently attenuated. Consequently, the difference between the actuator driving current and the target current grows wide, and the ascent velocity in the initial rise of the actuator driving current is accelerated, so that the amplitude L2 of the actuator driving current is larger than the amplitude L1 when the dither current is conventionally controlled so that the ratio between the turn-on time and the turn-off time is equal.

Accordingly, the amplitude L2 of the actuator driving current becomes the appropriate size, by overlapping the dither current with the actuator driving current, which enables the solenoid 2 to slightly vibrate. Therefore, the hysteresis of the solenoid 2 can be reduced, and the sliding resistance of the sliding portion such as a plunger provided with the fuel injection pump of the fuel injection device can be lowered, thereby preventing the hunting of the engine.

Figure 16:
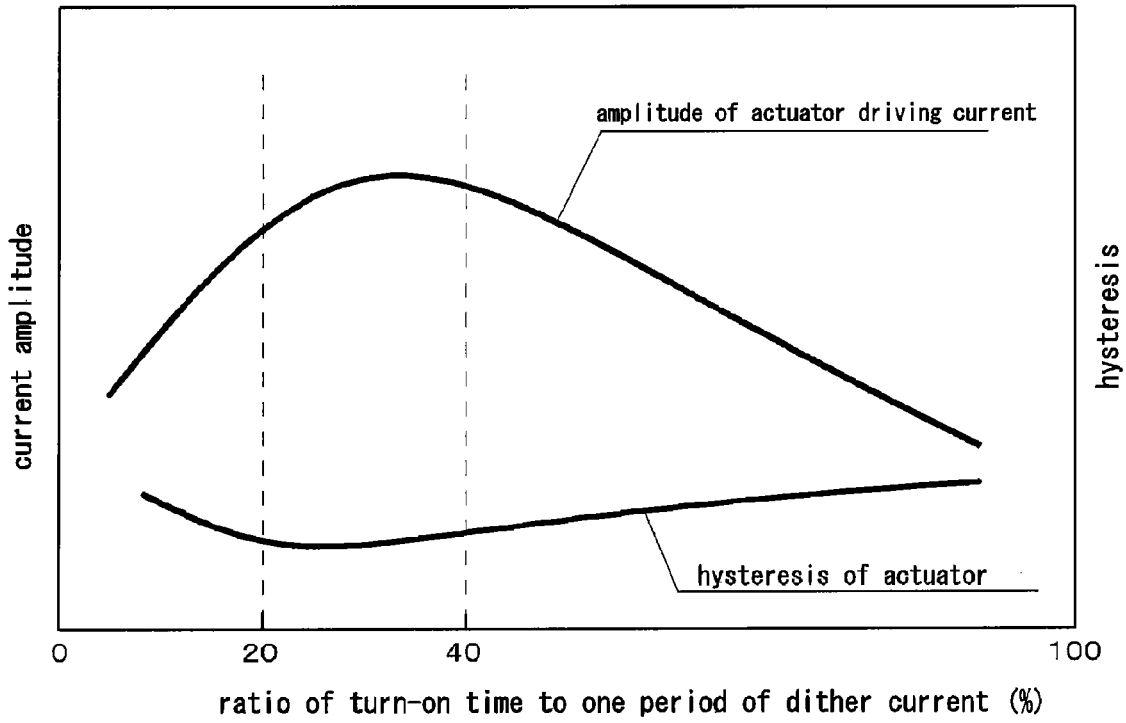
FIG. 16 is a diagram illustrating a relationship between the ratio of turn-on time with respect to one period of the dither current and the amplitude of the actuator driving current overlapped with the dither current or hysteresis of an actuator according to the fifth embodiment.

As described above, in the construction that controls the actuator driving current overlapped with the dither current, the ratio of the turn-on time to one period of the dither current, the amplitude of the actuator driving current and the hysteresis of the actuator have a relationship as shown in FIG. 16 where the ratio of the turn-on time is used as the axis of abscissas and the amplitude or the hysteresis is used as the axis of ordinate.

More specifically, the amplitude L2 of the actuator driving current becomes large as the ratio of the turn-on time falls from 50%, and is maximized at about 20 to 40%, as well as declines so as to convexly change from hence. Meanwhile, the hysteresis of the solenoid 2 becomes small as the ratio of the turn-on time falls from 50%, and is minimized at about 20 to 40%, as well as increases so as to concavely change from hence.

As is obvious from the above, when the ratio of the turn-on time to one period of the dither current is about 20 to 40%, the amplitude of the actuator driving current can be maximized and the hysteresis can be minimized, which becomes the optimal ratio of the turn-on time. Therefore, it is preferable that when the dither current is overlapped with the actuator driving current, the dither current is controlledby setting the dither signal so that the ratio of the turn-on time to one period of the dither current is 20 to 40%.

As seen from above, according to embodiment 5, in the electronic control governor 1, which adjusts the amount of fuel supplied to the engine so as to coincide the engine rotation speed with the target rotation speed, by controlling the actuator driving current overlapped with the dither current and by driving the solenoid (the actuator) 2 for actuating the fuel adjusting rack (the fuel adjusting means), the ratio between the turn-on time and the turn-off time in one period of the dither current is constructed so that it can be changed, and the ratio is changed depending on the velocity ratio between the ascent velocity and the descent velocity of the actuator driving current, so as to improve the response of the solenoid 2, thereby being able to increase the amplitude of the actuator driving current overlapped with the dither current to the adequate size, even when the actuator driving current is controlled so that the period thereof is accelerated. Therefore, by overlapping the dither current with the actuator driving current, the hysteresis of the solenoid 2 can be reduced, and the sliding resistance of the sliding portion such as the fuel adjusting rack provided with the fuel injection device can be lowered, thereby preventing the hunting of the engine.

In the electronic control governor of the embodiment 5, the ratio of the turn-on time to one period of the dither current overlapped with the actuator driving current can be optimized, by setting the ratio of the turn-on time to one period of the dither current at 20 to 40%, so that the hysteresis of the solenoid 2 and the sliding resistance of the sliding portion such as the fuel adjusting rack provided with the fuel injection device can be reduced.

The invention claimed is:

1. An electronic control governor comprising:

a fuel adjustment means for adjusting an amount of fuel supplied to an engine; and an actuator that is driven by supply of an actuator driving current overlapped with a dither current so as to drive the fuel adjustment means, thereby coinciding an engine rotation speed with a target rotation speed, wherein the electronic control governor stores a map indicating a relation of an amplitude of the dither current to an engine load, calculates an actual engine load, and controls the amplitude of dither current based on the map so as to correspond to the calculated actual engine load, thereby bringing an amplitude of the actuator driving current close to an adequate value regardless of change in supply quantity of the actuator driving current according to change of the engine load, wherein the whole region of the engine load in the map is set to include a low load region, a high load region, and a middle load region between the low and high load regions, wherein any dither current corresponding to engine load in the low load region is set to have a fixed first amplitude, wherein any dither current corresponding to engine load in the high load region is set to have a fixed second amplitude that is smaller than the first amplitude, and wherein an amplitude of the dither current corresponding to engine load in the middle load region is set to be gradually reduced from the first amplitude to the second amplitude as the engine load increases.

2. An electronic control governor comprising:

a fuel adjustment means for adjusting an amount of fuel supplied to an engine; and an actuator that is driven by supply of an actuator driving current overlapped with a dither current so as to drive the fuel adjustment means, thereby coinciding an engine rotation speed with a target rotation speed, wherein the electronic control governor stores a map indicating a relation of a period of the dither current to an engine load, calculates an actual engine load, and controls the period of dither current based on the map so as to correspond to the calculated actual engine load, thereby bringing an amplitude of the actuator driving current close to an adequate value regardless of change in supply quantity of the actuator driving current according to change of the engine load, wherein the whole region of the engine load in the map is set to include a low load region, a high load region, and a middle load region between the low and high load regions, wherein any dither current corresponding to engine load in the low load region is set to have a fixed first period, wherein any dither current corresponding to engine load in the high load region is set to have a fixed second period that is shorter than the first period, and wherein a period of the dither current corresponding to engine load in the middle load region is set to be gradually shortened from the first period to the second period as the engine load increases.

* * * * *